US005118151A

United States Patent [19]

Nicholas, Jr. et al.

[11] Patent Number: 5,118,151

[45] Date of Patent: Jun. 2, 1992

[54] ADJUSTABLE DOOR STRIKE AND MOUNTING TEMPLATE

[76] Inventors: Marvin R. Nicholas, Jr., 3800 Flamingo Way, Mesquite, Tex. 75150; Lenard Fox, 4106 Ashville, Garland, Tex. 75041

[21] Appl. No.: 730,484

[22] Filed: Jul. 16, 1991

[51] Int. Cl.[5] ..... E05R 15/02

[52] U.S. Cl. ..... 292/341.19; 29/437

[58] Field of Search ..... 292/341.18, 341.19, 292/346, 340; 29/437

[56] References Cited

U.S. PATENT DOCUMENTS

| | | | |
|---|---|---|---|
| 1,272,115 | 7/1918 | Russell | 292/341.19 |
| 1,733,412 | 10/1929 | Karns | 292/341.18 |
| 1,852,854 | 9/1932 | Norring | 292/341.19 |
| 2,086,049 | 7/1937 | Schlaman | 292/341.19 |
| 2,094,119 | 9/1937 | Flora | 292/340 |
| 2,153,080 | 4/1939 | Flora | 292/341.19 |
| 2,781,219 | 2/1957 | Bahorik | 292/341.18 |
| 2,990,211 | 6/1961 | Wartain | 292/341.18 |
| 3,257,139 | 6/1966 | Russell et al. | 292/341.18 |
| 3,416,829 | 12/1968 | Russell et al. | 292/341.19 |
| 3,506,293 | 4/1970 | Russell et al. | 292/341.19 |
| 4,105,235 | 8/1978 | Thiel | 292/341.18 |
| 4,453,752 | 6/1984 | McKann | 292/341.19 |
| 4,492,397 | 1/1985 | Allenbaugh | 292/341.18 |
| 4,892,341 | 1/1990 | Dietrich | 292/341.12 |

*Primary Examiner*—Richard E. Moore
*Attorney, Agent, or Firm*—Baker & Botts

[57] ABSTRACT

An adjustable door strike having a striker plate (2), a main body (10) and a slider plate (16, 26, 32). The main body (10) is affixed to a door jamb with the slider plate (16, 26, 32) between the door jamb and the main body (10) and adjustably mounted for receiving a standard striker plate (2). The main body (10) is provided with an elongated aperture (12) in the vertical direction which permits the striker plate (2) to have a continuous range of adjustments in the vertical direction. Also described is a mounting template (50) for facilitating the installation of a door strike. This invention allows for mounting a door lock with either or both a latch and a deadbolt without adversely affecting the door jamb in any way.

12 Claims, 2 Drawing Sheets

FIG. 3
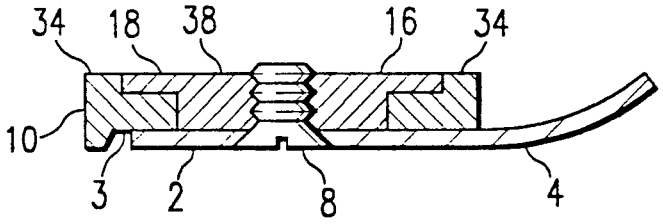
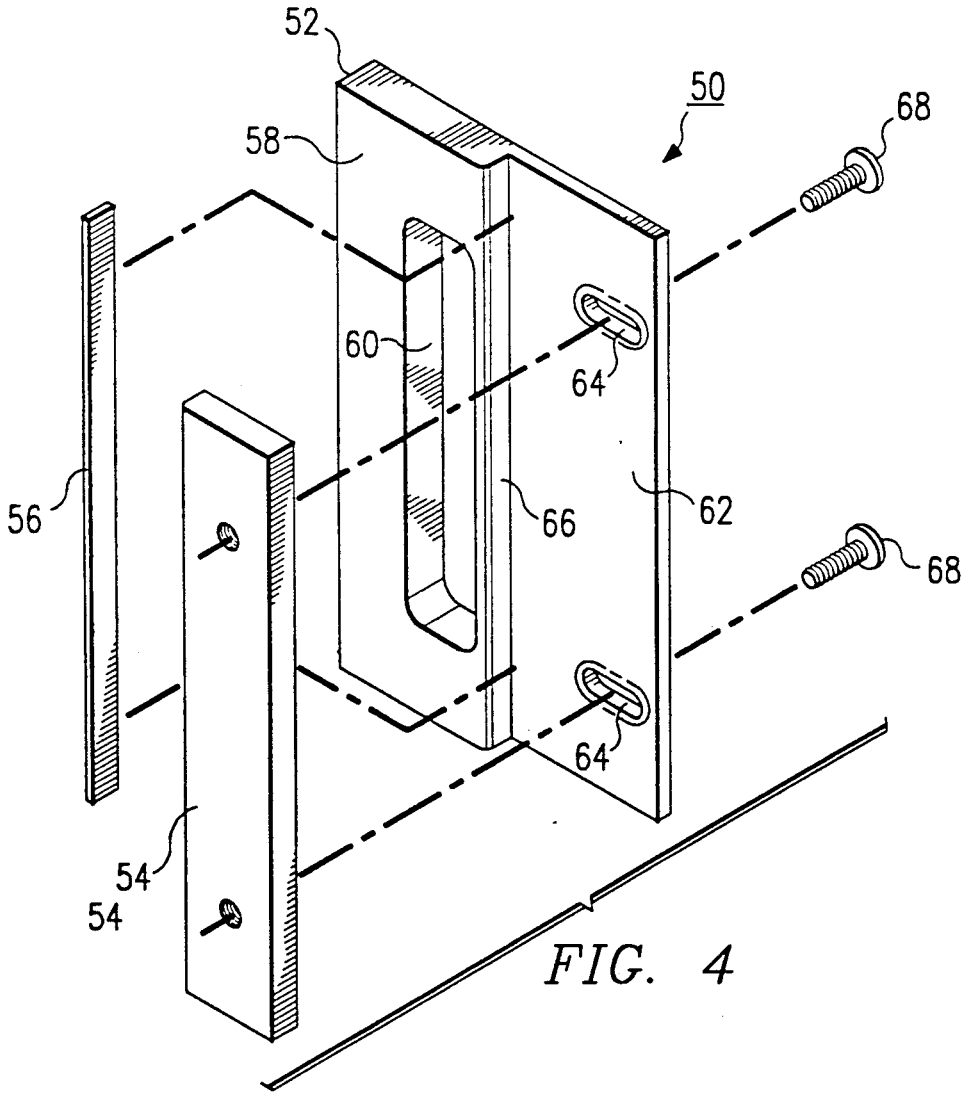
FIG. 4

ADJUSTABLE DOOR STRIKE AND MOUNTING TEMPLATE

TECHNICAL FIELD OF THE INVENTION

The present invention relates to door hardware and more particularly to an adjustable door strike that permits continuous adjustment of the striker plate. The invention further relates to a mounting template for preparing a door jamb to receive the adjustable door strike of the present invention.

BACKGROUND OF THE INVENTION

Conventional door hardware includes a doorlock, whether of the latch or deadbolt type, and a cooperating strike mounted on the door jamb to receive the latch or bolt. In the most common arrangement, the strike is a simple stamped metal plate with an aperture of suitable size and shape. In a typical arrangement, the strike is mounted to the door jamb using wood screws that are fixed to the door jamb.

For the door and the door jamb to work properly, it is essential that the lock or deadbolt fit perfectly in the hole or aperture of the door strike. If either the strike or the lock are out of position and do not mate correctly, the door will not close properly creating a serious security risk. The problem with accurately positioning the lock and strike is twofold: First, there is the problem involved in the original mounting of the lock and the strike. Typically, the lock is mounted in the door first and then the strike is located in the door jamb so that it matches identically to the lock. The second problem arises when a building settles or changes relative position as a consequence of age or other factors. In those circumstances, it is typical that a door and door jamb will become out of alignment with one another so that the lock does not mate properly with the strike. This creates a serious problem not only with regard to security and the aesthetic look of the door; but, as one attempts to reposition the strike by reboring holes into the door jamb, it weakens the structure of the door jamb and creates additional security and aesthetic problems. Therefore, a need has been recognized in the art for a strike that is adjustable without reboring the door jamb.

Another problem faced in the art of door hardware is that generally different strikes are used depending upon whether the lock includes just a simple latch mechanism or includes a deadbolt. The problem is particularly significant should one choose to replace a lock with a deadbolt or add a deadbolt to a lock with a latch. Therefore, another problem faced by the art is to provide a universal door strike that is adaptable for use with both a latch and a deadbolt without reboring the door jamb.

The foregoing problems have been recognized in the art for many years and while a number of solutions have been proposed, none of them satisfies both problems in a device that is both simple to use as well as easy to assemble and mount in the door jamb. The inadequacies of the prior art is shown by the following United States patents.

U.S. Pat. No. 4,892,341 to Dietrich for a Self-adjusting Door Strike describes a device that uses a compensating member spanning the strike opening. The compensating member is comprised of a resilient spring loaded member and compensates for the relative position of the latch/deadbolt and door jamb by a biasing member. The disadvantages of this device is that it is complicated to manufacture and assemble and requires spring loaded parts which are subject to fatigue and therefore, pose serious security risks. It does not permit mounting both a latch and a deadbolt.

U.S. Pat. No. 4,492,397 to Allenbaugh for an Adjustable Strike describes a door strike that is primarily adjustable in the horizontal position. It provides for a vertical adjustment only by the use of oversized mounting holes. Thus, the strike has both its aperture and mounting means in one piece. A significant disadvantage of the Allenbaugh device is that the vertical adjustment is minor and requires the reboring of the mounting socket in the door jamb. A second problem with the Allenbaugh device is that it is not suitable for mounting both a latch and a deadbolt without reboring the door jamb.

U.S. Pat. No. 3,506,293 to Russell et al. for Adjustable Strike describes a strike with two plates: an outer and inner plate. The inner plate is fastened to the door jamb and the outer plate then is mounted over it and provides for adjustment in the horizontal direction only. No vertical adjustment is provided without reboring the door jamb.

U.S. Pat. No. 3,416,829 to Russell et al. for Adjustable Strike provides for an adjustment in the horizontal direction but no adjustment in the vertical position. In order to adjust the vertical position, the Russell device requires reboring the door jamb and reassembling the device. As mentioned before, this is both aesthetically displeasing and poses a security risk.

U.S Pat. No. 3,257,139 to Russell et al. for Adjustable Strike describes a door strike that is adjustable only in the horizontal direction by use of elongated mounting apertures. No vertical adjustment is contemplated without reboring the door jamb.

U.S. Pat. No. 2,990,211 to Wartain for Adjustable Strike Plate describes another strike that is adjustable only in the horizontal direction using elongated mounting holes. Wartain's device cannot be vertically adjusted without reboring the door jamb.

U.S. Pat. No. 2,781,219 to Bahorik for Adjustable Strike Plate offers a variation to the elongated hole approach by providing two embodiments. In one embodiment, there is provided an elongated notched aperture that permits adjustment of the strike in the horizontal direction only. In a second embodiment, the strike plate assembly includes rows and columns of apertures that mate with the securing plates. The primary purpose is to permit adjustment in the horizontal direction with some vertical adjustment based upon the size of the opening in the elongated mounting holes. The Bahorik device does not provide for the universal mounting of either a latch or a deadbolt and is severely limited with respect to vertical adjustment in that it is not continuously adjustable.

U.S. Pat. No. 2,094,119 to Flora for Adjustable Lock Strike shows a spring loaded system that provides both lateral and longitudinal alignment of the strike plate. The disadvantage is that the springs will fatigue over time and it provides only limited vertical and lateral adjustment. A further disadvantage of the Flora device is that it requires that both the latch and deadbolt strikes be included in a single part.

U.S. Pat. No. 1,733,412 to Karns for Adjustable Striker Plate discloses an adjustable striker that is adjustable only in the horizontal direction and therefore has the disadvantage that it cannot be adjusted vertically without reboring the door jamb creating both the aesthetic and security problems that have been previously mentioned.

No prior art device overcomes the problems mentioned with respect to continuous adjustment in the vertical direction without reboring the door jamb or providing adaptability in receiving either or both a latch and deadbolt.

Another problem faced by the art concerns the preparation of the door jamb for receiving the universal door strike. In the prior art, carpenters would use a chisel to hollow out the location where the door strike was to be positioned. Thus, each installation was essentially a customized operation. While the foregoing patents all describe various door strikes, there is no teaching or suggestion of a mounting template for installing a door strike in a door jamb.

SUMMARY OF THE INVENTION

This invention overcomes the disadvantages and problems of the prior art and provides for a door strike that is universally adapted for either or both a latch and deadbolt and is continuously adjustable in the vertical position. The adjustment can be made using a simple screwdriver without any further modification to the door jamb. These and other advantages will be readily apparent to those of ordinary skill in the art.

The present invention is directed to an adjustable door strike. The adjustable door strike has a striker plate, a main body, and a slide plate. The striker plate has apertures for mounting means, such as screws, and is adapted for receiving a latch, deadbolt or both. The main body has an aperture dimensioned to be larger than the striker plate and is adapted for receiving the striker plate. The slide plate has substantially the same dimensions as the striker plate. The slide plate is adapted for receiving the mounting means from the striker plate. The striker plate is positioned on the main body in relationship to the striker plate such that the main body is located between the slide plate and the striker plate so that when the mounting means is affixed to the slide plate, the striker plate is rigidly fixed in position.

A technical advantage of this invention is that an adjustable door strike is provided that is both easy to install and simple to assemble. Another technical advantage is that the striker plate is continuously adjustable in the vertical position without reboring the door jamb to provide for flexibility in mounting door hardware.

In another embodiment of the invention, a method for assembling an adjustable door strike is provided. In the first step, a hole is bored in a door jamb to receive a main body having a support surface and a slide surface opposite the support surface and adjacent to the door jamb. In the second step, the slide plate is placed next to the slide surface of the main body in the bored hole. In the next step, the striker plate is placed on the main body. In the fourth step, the main body is secured to the door jamb. In the fifth step, the striker plate is positioned to mate with the door lock. In the final step, the striker plate is secured to the slide plate on the support surface of the main body.

Another embodiment of the invention is directed to a mounting template for preparing a door jamb to receive a door strike. The mounting template comprises a main body and a slide bar. The main body has a raised portion with an aperture formed therein and a recessed portion having mounting means formed therein. The slide bar is adjustably fastened to the recessed portion of the base by the mounting means.

A technical advantage of the present invention is that by the cooperation of the main body and the slide bar the template is clamped to the door stop permitting the use of power tools, such as a router, to bore out the door jamb in the location designated for receiving the door strike. Another technical advantage of the template is that the exact amount of wood is removed from the door jamb for insertion of the door strike.

BRIEF DESCRIPTION OF THE DRAWINGS

Referring now to the drawings, wherein like reference numerals are used to designate like parts, a preferred embodiment of the invention is described.

FIG. 3 is a cross-section of the adjustable door strike taken along the lines 3—3 of FIG. 1; and FIG. 4 is an exploded view of a mounting template in accord with the present invention.

DETAILED DESCRIPTION OF THE INVENTION

Figure 1:
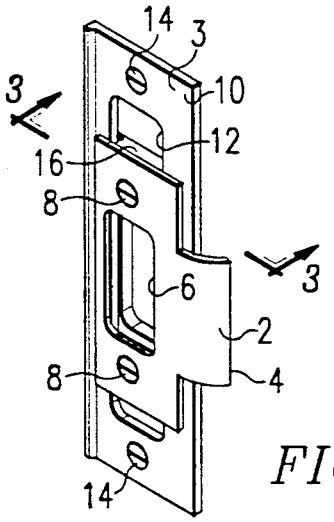
FIG. 1 depicts the adjustable door strike of the present invention.

Referring now to FIG. 1, an adjustable door strike is shown having a striker plate 2 with a lip 4. Striker plate 2 is mounted on mounting surface 3 of main body 10 and has aperture 6 for receiving a door lock having either a latch or deadbolt. Striker plate 2 is also provided with mounting means which in the preferred embodiment are screws. In an alternative embodiment, a striker box (now shown) may be used with striker plate 2. Using a striker box does require making a deeper cut into the door jamb. The screws 8 through door striker 2 are fastened to slider plate 16 through aperture 12 of main body 10. Main body 10 is configured to fit in a bored hole in a door jamb (not shown) as in a conventional striker plate assembly. Main body 10, however, is larger than conventional striker plates, as is shown clearly in the figures, and requires a larger bored area. Main body 10 is fastened to the door jamb by means of fastening means 14 which in the preferred embodiment are wood screws. Wood screws 14 can be selected of such a length that they penetrate through the door jamb and attach to structural support members such as the studs in a wall of a building. This provides not only added support but additional security. Even more security is provided by the enhanced thickness of main body 10 over conventional striker plates.

In operation, should it be necessary to adjust striker plate 2 in the vertical direction, a user need only loosen screws 8 and then may adjust the striker plate 2 up or down in aperture 12 in a continuous range of adjustments. Once the striker plate 2 is located in the right position, the user need only tighten screws 8 which causes striker plate 2 to be fastened in position on main body 10.

Figure 2:
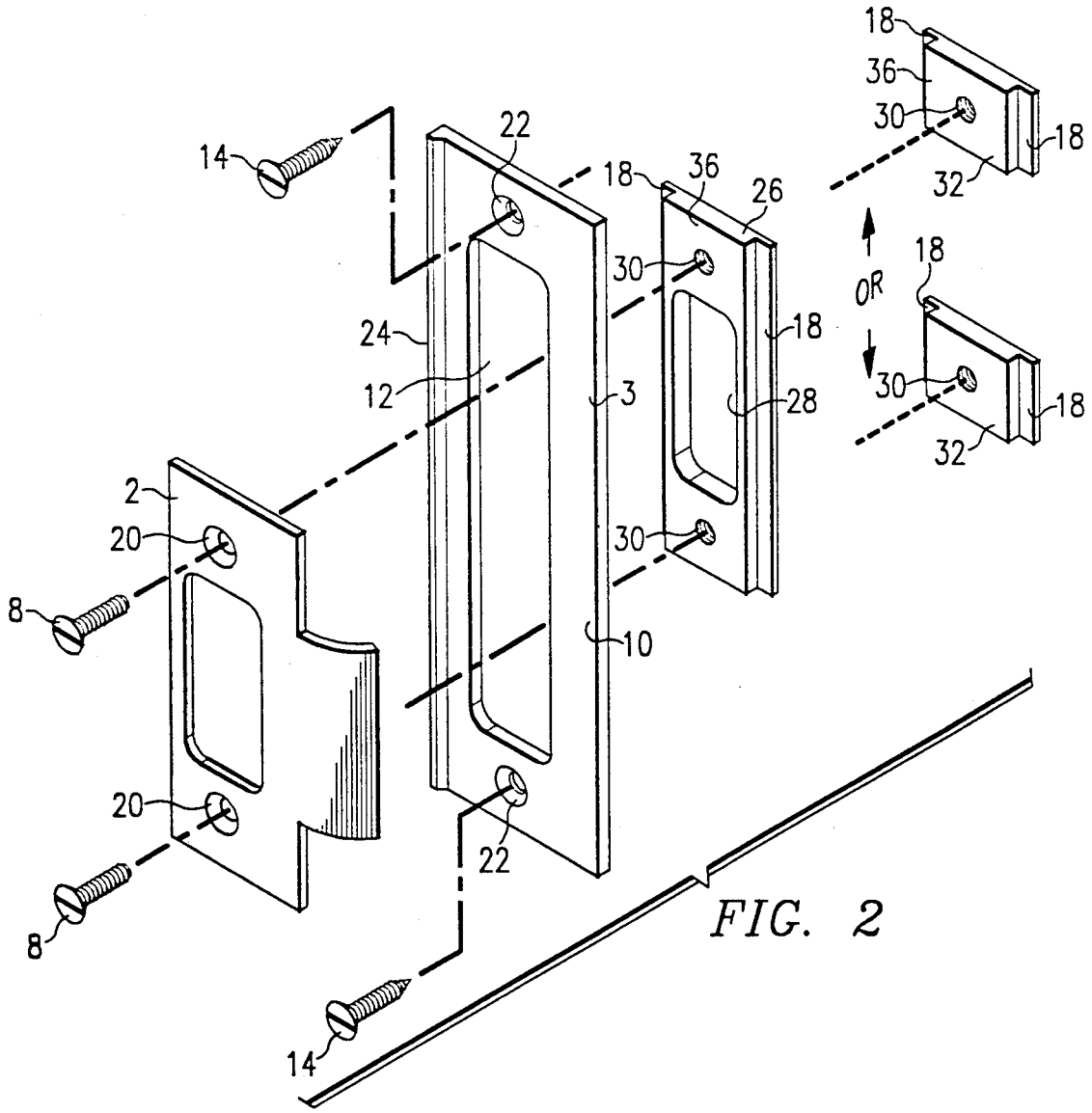
FIG. 2 is an exploded view of the various parts comprising the adjustable door strike of the present invention.

Referring now to FIG. 2, the present invention is described in an exploded view to show the individual components and how they are assembled. Assembly begins by boring out a hole, as previously described, in a door jamb.

In FIG. 2, two alternative embodiments for a slider plate 16 are shown. In one embodiment, single slider plate 26 is a single piece having a slider aperture 28 and mounting means receivers 30. Single slider plate 26 has shoulders 18 that mate to support 34 of main body 10. The slider plate has a raised body 36 which projects through aperture 12 of main body 10 to meet mounting apertures 20 of striker plate 2. An alternative embodiment of the slider plate 16 is shown as two universal slider plates 32. Universal slider plates 32 can be used with any sized striker plate for both a latch mechanism or deadbolt. Slider plates 32 also have mounting means receivers 30, shoulders 18, and raised body 36. As is clear, adjustable slider plates 32 are easier to manufacture than slider plate 26 in that no boring step is required to construct slider aperture 28.

In the assembly of the adjustable door strike, of the present invention, once the hole is bored in the door jamb, then either slider plate 26 or slider plates 32 are positioned on main body support surface 34 so that raised body 36 projects through aperture 12 of main body 10. The wall surface 38 (FIG. 3) of slider plates 16, 26, or 32 is positioned against the wall of the bored hole of the door jamb and raised body 36 projects through main body 10. Then mounting apertures 20 of slider plate 2 are positioned to overlap mounting means receivers 30. Screws 8 are fastened loosely to hold striker plate 2 and slider plates 16, 26, 32 in position. The next step is to secure main body 10 to the door jamb. The next step is then to bring the door lock into position with the striker plate and make fine adjustments to the vertical position so that the lock (not shown) and striker plate aperture 6 are aligned and then bolt down screws 8 to tightly fasten striker plate 2 to main body 10.

Referring now to FIG. 3, a cross-section of FIG. 1 is shown along the lines 3-3. Striker plate 2 is shown fastened to slider plate 16, 26, 32 using screw 8. Slider plate 16 is fastened by screw 8 so that shoulders 18 are pressed to main body support surface 34. When screw 8 is fastened tightly, it causes main body 10 to be pressed between striker plate 2 and slider plate 16 along mounting surface 3 and support surface 34, thus providing for a very secure door strike.

Referring now to FIG. 4, a mounting template 50 is shown comprised of a main body 52, a slider bar 54 and a shim means 56. Main body 52 has raised portion 58 with an aperture 60 formed therein and a recessed portion 62 with mounting means 64 formed therein. Shim means 56 is provided to accommodate non-standard (thicker) doors.

In operation, template 50 is fastened to the door stop in the position where the door strike is to be installed. The user can then bore out a hole using aperture 60 as a guide with a router. Raised portion 58 of main body 52 is placed against one side of the door stop over the position where the door strike is to be installed. Then slider bar 54 is placed against the opposite side of the door stop so that shoulder 66 of raised portion 58 abuts one side of the door stop while slider bar 54 abuts the other side. Slider bar 54 then is fastened to the recessed portion 62 of main body 52 by mounting means 64 which in the preferred embodiment are screws 68.

In the preferred embodiment, both the door strike and template of the present invention can be constructed of stainless steel, brass or aluminum or other suitable material. It is also possible that mounting template 50 may be constructed of wood, plastic or other rigid material.

In the above description, it will be seen by those having skill in the art that under the present invention, an adjustable door strike is provided that is continuously adjustable in the vertical direction and is adaptable to either or both a latch and deadbolt of a door lock mechanism. Since the adjustable door strike of the present invention has a main body that is permanently affixed to the door jamb structure and the striker plate is adjustable, a door strike assembly is provided that is both more secure and aesthetically pleasing than prior art devices. Also a template is provided for facilitating the installation of a door strike. While the invention has been particularly shown and described with reference to a preferred embodiment, it will be understood by those skilled in the art that various other changes in form and detail may be made without departing from the spirit and scope of the invention.

What is claimed is:

1. An adjustable door strike comprising:

a standard striker plate having apertures for receiving a plurality of mounting means and adapted for receiving a latch;

a main body for supporting said standard striker plate and having mounting and support surfaces and thickened sidewalls forming an aperture that is substantially larger vertically than the height of the standard striker plate, the support surface having recesses adjacent to the sidewalls; and a slider plate for holding the standard striker plate against the mounting surface and having a raised portion dimensioned to fit in the aperture and flush with the mounting surface and adapted for receiving said mounting means from said striker plate, for supporting the standard striker plate and also having shoulders adapted to mate with the recesses for holding the standard striker plate in position.

2. The adjustable door strike of claim 1 wherein said mounting means comprises at least two screws.

3. The adjustable door strike of claim 1 wherein said main body is affixed to a door jamb with a fastener means.

4. The adjustable door strike of claim 3 wherein said fastener means is also affixed to a structural component supporting said door jamb.

5. The adjustable door strike of claim 1 wherein said striker plate and said slider plate are cooperatively adapted so that said striker plate may be adjusted in a continuous range of vertical positions.

6. An adjustable door strike comprising:

a standard striker plate adapted for receiving a latch and having apertures for receiving a plurality of fastening members;

a main body for supporting said standard striker plate in a continuous range of vertical positions and having sidewalls, a mounting surface and a support surface with recesses adjacent to the sidewalls, forming an aperture vertically higher than the vertical dimension of the standard striker plate; and a plurality of slider plates, each of the slider plates adapted for receiving one of said fastening members and being substantially smaller than said striker plate and affixed to the recesses of the support surface of said main body for securing said striker plate to said main body.

7. The adjustable door strike of claim 6 wherein said fastening members comprise screws.

8. The adjustable door strike of claim 6 wherein said main body is affixed to said door jamb with a

9. The adjustable door strike of claim 8 wherein said mounting means is also affixed to a structural component supporting said door jamb.

10. The adjustable door strike of claim 6 wherein said slider plates and said main body are cooperatively adapted so that said slider plates may be adjusted in a continuous range of vertical positions.

11. The adjustable door strike of claim 6 wherein said plurality of slider plates comprises two slider plates.

12. A method for assembling an adjustable door strike comprising the following steps:

boring a hole in a door jamb to receive a main body having an aperture defined by thickened sidewalls, a mounting surface and a support surface with recesses opposite said mounting surface and adjacent to said door jamb;

installing at least one slider plate having shoulders adjacent a support surface of said main body in said bored hole;

positioning the slider plate shoulders in the support surface recesses adjacent to the sidewalls;

placing a standard striker plate on said main body mounting surface with a raised portion of said slider plate in said aperture;

securing said main body to said door jamb;

positioning said standard striker plate to mate with a door lock; and securing said standard striker plate to said slide plate on said mounting surface of said main body.

* * * * *